US010965004B2

(12) United States Patent
Park et al.

(10) Patent No.: US 10,965,004 B2
(45) Date of Patent: Mar. 30, 2021

(54) CHIP ANTENNA MODULE

(71) Applicant: Samsung Electro-Mechanics Co., Ltd., Suwon-si (KR)

(72) Inventors: Ju Hyoung Park, Suwon-si (KR); Myeong Woo Han, Suwon-si (KR); Jeong Ki Ryoo, Suwon-si (KR); Dae Ki Lim, Suwon-si (KR); Nam Ki Kim, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 11 days.

(21) Appl. No.: 16/259,005

(22) Filed: Jan. 28, 2019

(65) Prior Publication Data

US 2020/0028238 A1 Jan. 23, 2020

(30) Foreign Application Priority Data

Jul. 17, 2018 (KR) ..... 10-2018-0082716

(51) Int. Cl.

| | |
|---|---|
| ***H01Q 1/22*** | (2006.01) |
| ***H01Q 1/24*** | (2006.01) |
| ***H01Q 9/04*** | (2006.01) |
| ***H01Q 1/38*** | (2006.01) |

(52) U.S. Cl.

CPC ..... *H01Q 1/2283* (2013.01); *H01Q 1/243* (2013.01); *H01Q 1/38* (2013.01); *H01Q 9/0407* (2013.01)

(58) Field of Classification Search

CPC ..... H01Q 1/2283; H01Q 1/243; H01Q 1/38; H01Q 9/0407; H01Q 19/22; H01Q 19/26; H01Q 19/30; H01Q 5/378; H01Q 5/371; H01Q 5/385; H01Q 5/392

See application file for complete search history.

(56) References Cited

U.S. PATENT DOCUMENTS

| | | | | |
|---|---|---|---|---|
| 8,570,234 | B2 | 10/2013 | Tsai et al. | |
| 2002/0027018 | A1* | 3/2002 | Chikagawa | H01B 3/12 174/255 |
| 2016/0056544 | A1* | 2/2016 | Garcia | H01Q 1/38 343/725 |
| 2016/0126635 | A1* | 5/2016 | Hamabe | H01Q 1/48 343/700 MS |
| 2018/0048075 | A1 | 2/2018 | Park et al. | |
| 2018/0205155 | A1* | 7/2018 | Mizunuma | H01Q 21/0025 |

FOREIGN PATENT DOCUMENTS

| | | | |
|---|---|---|---|
| KR | 10-1355865 | B1 | 2/2014 |
| KR | 10-2018-0017667 | A | 2/2018 |

* cited by examiner

*Primary Examiner* — Wei (Victor) Y Chan
(74) *Attorney, Agent, or Firm* — NSIP Law

(57) ABSTRACT

A chip antenna module includes a substrate having layers; a chip antenna mounted on one surface of the substrate to radiate a radio signal, the chip antenna having a body portion formed of a dielectric substance, and a ground portion and a radiating portion disposed on opposite surfaces of the body portion; and an auxiliary patch disposed below the radiating portion on at least one layer of the substrate.

23 Claims, 16 Drawing Sheets

CHIP ANTENNA MODULE

CROSS-REFERENCE TO RELATED APPLICATION

This application claims the benefit under 35 USC 119(a) of Korean Patent Application No. 10-2018-0082716 filed on Jul. 17, 2018 in the Korean Intellectual Property Office, the entire disclosure of which is incorporated herein by reference for all purposes.

BACKGROUND

1. Field

The following description relates to a chip antenna module.

2. Description of Background

A 5G communications system is implemented in higher frequency (mmWave) bands, e.g., 10 GHz to 100 GHz bands, to achieve higher data transfer rates. In order to reduce propagation loss of radio waves and increase a transmission distance of radio waves, beamforming, large-scale multiple-input multiple-output (MIMO), full-dimensional MIMO (FD-MIMO), array antennas, analog beamforming, and large-scale antenna techniques are discussed in the 5G communications system.

Meanwhile, mobile communications terminals such as a cellular phone, a personal digital assistant (PDA), a navigation device, a notebook computer, and the like, supporting wireless communications, have been developed to have functions such as code division multiple access (CDMA), a wireless local area network (WLAN), digital multimedia broadcasting (DMB), near field communications (NFC), and the like. One of the most important components enabling these functions is an antenna.

Meanwhile, since a wavelength is as small as several millimeters in a millimeter wave communications band, it is difficult to use a conventional antenna. Therefore, a chip antenna module, suitable for the millimeter wave communications band, is required.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a chip antenna module includes a substrate having layers; a chip antenna mounted on one surface of the substrate to radiate a radio signal, the chip antenna having a body portion formed of a dielectric substance, and a ground portion and a radiating portion disposed on opposite surfaces of the body portion; and an auxiliary patch disposed below the radiating portion on at least one layer of the substrate.

The auxiliary patch may be disposed in a portion of the substrate corresponding to the radiating portion with respect to a mounting direction of the chip antenna on the substrate.

A length of the auxiliary patch may be the same as a length of the radiating portion.

The auxiliary patch may include auxiliary patches disposed on different layers of the substrate.

The chip antenna module may include an auxiliary via connecting two or more of the auxiliary patches to each other.

At least one of the auxiliary patches may be electrically separated from the other auxiliary patches.

The auxiliary via may be electrically connected to the radiating portion.

The auxiliary via may be electrically separated from the radiating portion.

The auxiliary via may be disposed in a central region of the auxiliary patches in a length direction of the auxiliary patches.

The auxiliary via may include two auxiliary vias, and the two auxiliary vias may be disposed in different edge regions of the auxiliary patches in a length direction of the auxiliary patches.

The auxiliary via may include auxiliary vias, and the auxiliary vias may be spaced apart from each other in a length direction of the auxiliary patches.

In another general aspect, a chip antenna module includes a substrate having layers; a chip antenna including a first block formed of a dielectric substance and a second block formed of a dielectric substance, a radiating portion disposed between the first block and the second block, a ground portion disposed to face the radiating portion with the first block interposed between the ground portion and the radiating portion, and a director disposed to face the radiating portion with the second block interposed between the director and the radiating portion; and an auxiliary patch disposed below one or both of the radiating portion and the director on at least one layer of the substrate.

The auxiliary patch may include a first auxiliary patch disposed below the radiating portion and a second auxiliary patch disposed below the director.

The first auxiliary patch may be disposed in a portion of the substrate corresponding to the radiating portion with respect to a mounting direction of the chip antenna on the substrate, and the second auxiliary patch may be disposed in a portion of the substrate corresponding to the director with respect to the mounting direction.

A length of the first auxiliary patch may be the same as a length of the radiating portion, and a length of the second auxiliary patch may be the same as a length of the director.

The auxiliary patch may include auxiliary patches disposed on different layers of the substrate.

The chip antenna module may include an auxiliary via connecting the auxiliary patches to each other.

At least two of the auxiliary patches may be connected to each other by the auxiliary via, and at least one auxiliary patch may be electrically separated from the other auxiliary patches.

The auxiliary via may be disposed in a central region of the auxiliary patches in a length direction of the auxiliary patches.

The auxiliary via may include two auxiliary vias, and the two auxiliary vias are disposed in different edge regions of the auxiliary patches in a length direction of the auxiliary patches.

The auxiliary via may include auxiliary vias, and the auxiliary vias may be spaced apart from each other in a length direction of the auxiliary patches.

The chip antenna module may be included in an electronic device.

In another general aspect, a chip antenna module includes a substrate, a chip antenna mounted the substrate and including a radiating portion to radiate a radio signal, and auxiliary patches disposed in the substrate at positions corresponding to the radiating portion with respect to a mounting direction of the chip antenna on the substrate, the auxiliary patches including at least two auxiliary patches that are electrically connected to each other and at least one auxiliary patch that is not electrically connected to any other of the auxiliary patches.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1A:
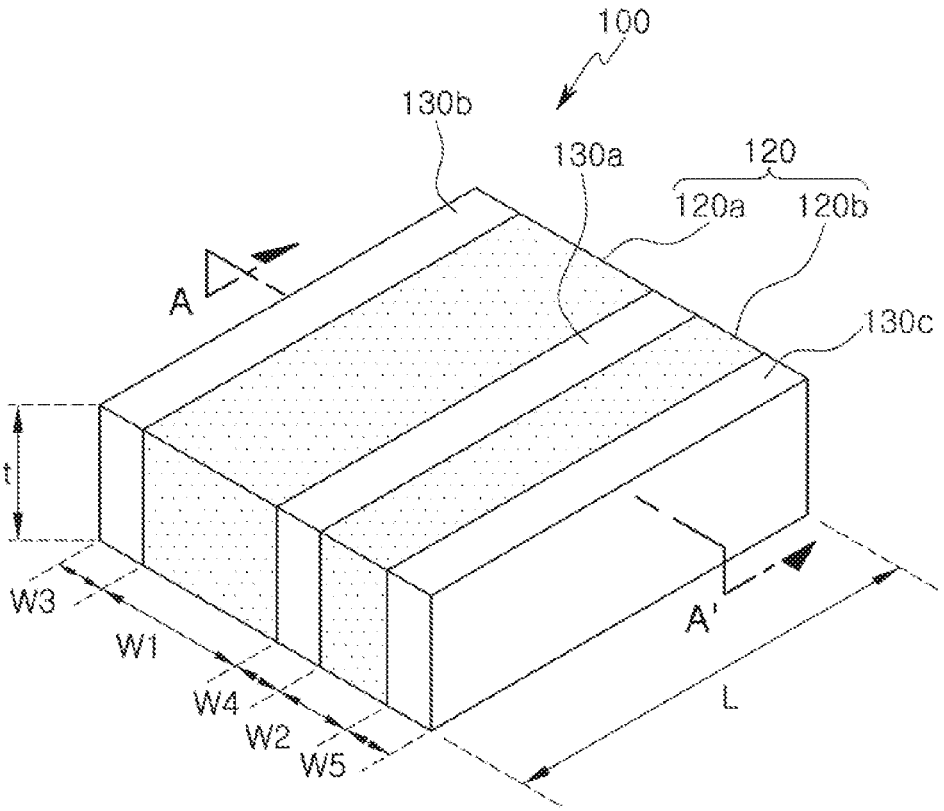
FIGS. 1A and 1B are perspective views of a chip antenna according to examples.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

Hereinafter, examples will now be described in detail with reference to the accompanying drawings.

A chip antenna module may operate in a high frequency region and may operate in a millimeter wave communications band. For example, the chip antenna module may operate in a frequency band between 20 GHz and 60 GHz. In addition, the chip antenna module may be mounted in an electronic device configured to receive or transmit and receive a radio signal. For example, a chip antenna may be mounted in a portable telephone, a portable notebook PC, a drone, and the like.

Figure 1B:
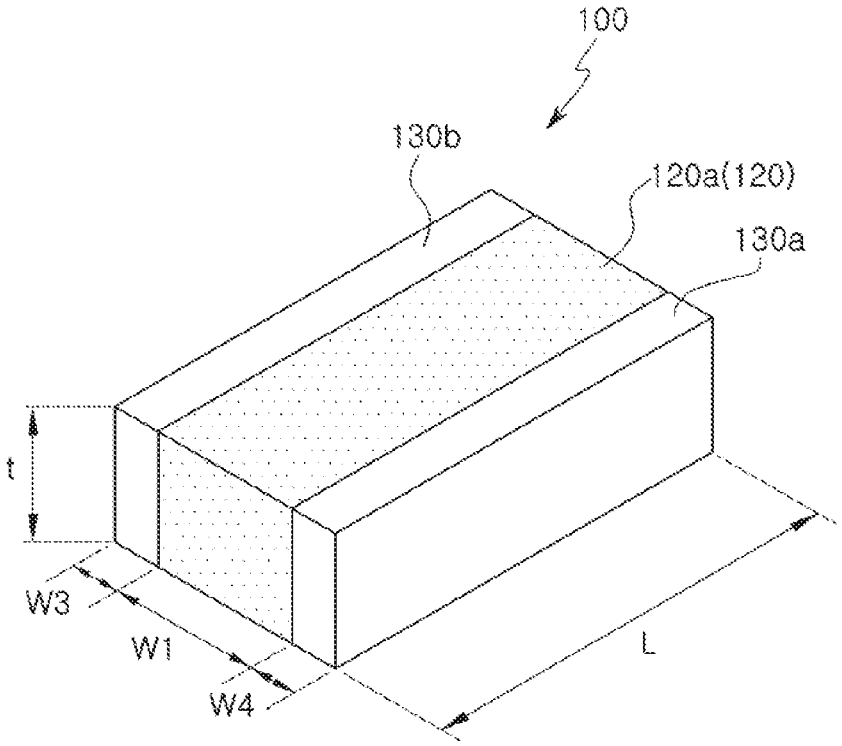
Figure 2:
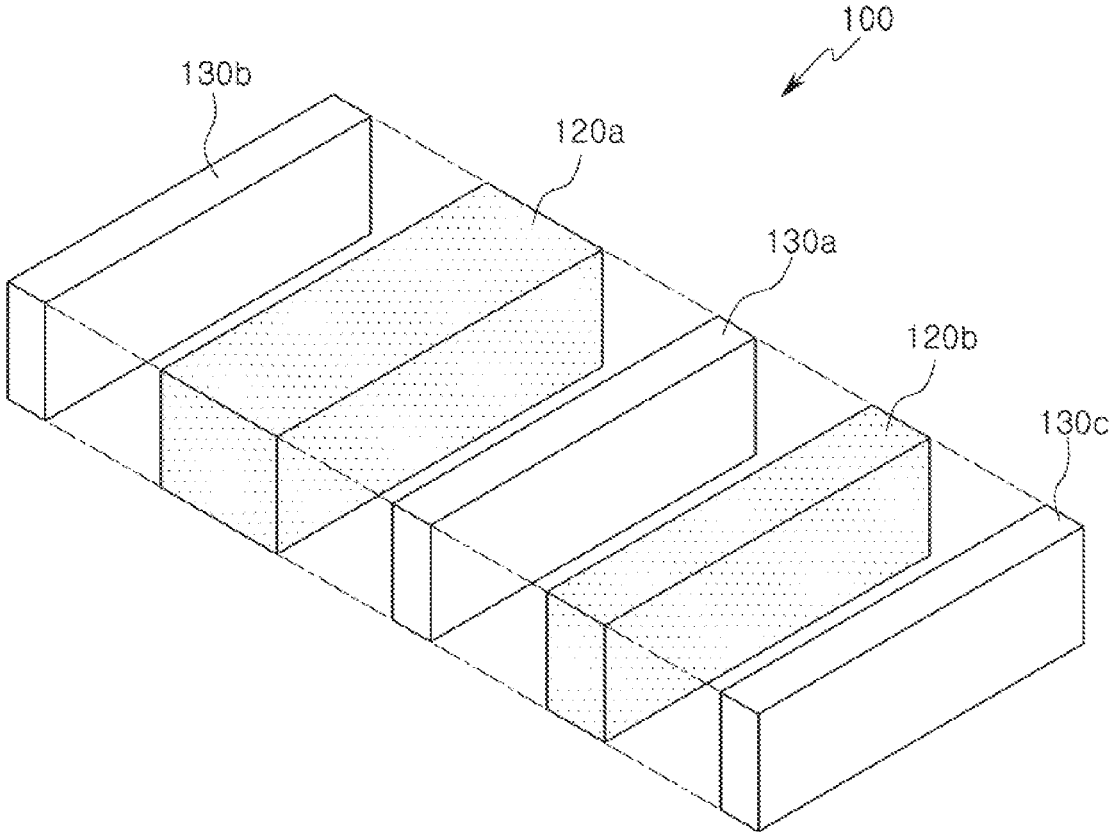
FIG. 2 is an exploded perspective view of the chip antenna illustrated in FIG. 1A.
Figure 3:
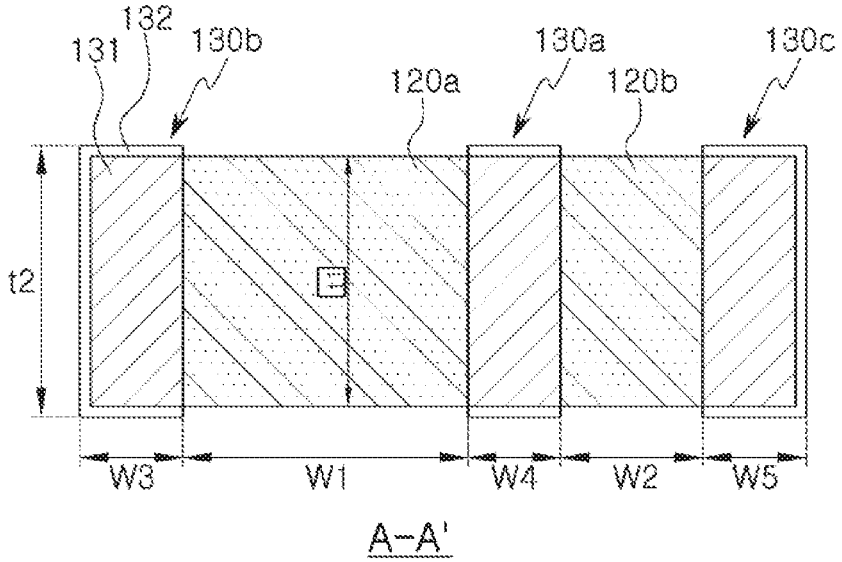
FIG. 3 is a cross-sectional view taken along line A-A' of FIG. 1A.

FIG. 1A is a perspective view of a chip antenna according to an example, FIG. 1B is a perspective view of a chip antenna according to another example, FIG. 2 is an exploded perspective view of the chip antenna according to the example of FIG. 1A, and FIG. 3 is a cross-sectional view taken along line A-A' of FIG. 1A.

A chip antenna will be described with reference to FIGS. 1A, 1B, 2, and 3.

A chip antenna 100 may be formed in a hexahedral shape as a whole, and may be mounted on a substrate through a conductive adhesive such as solders.

The chip antenna 100 may include a body portion 120, a radiating portion 130*a*, a ground portion 130*b*, and director 130*c*.

The body portion 120 may include a first block 120*a* disposed between the radiating portion 130*a* and the ground portion 130*b*, and a second block 120*b* disposed between the radiating portion 130*a* and the director 130*c*.

Both the first block 120*a* and the second block 120*b* may have a hexahedral shape and may be formed of a dielectric substance. For example, the body portion 120 may be formed of a polymer or a ceramic sintered body having a dielectric constant.

The chip antenna may be a chip antenna used in a millimeter wave communications band. Therefore, in response to a length of a wavelength, a total width (W4+W1+W3) formed by the radiating portion 130*a*, the first block 120*a*, and the ground portion 130*b* may be formed to be 2 mm or less. In addition, the chip antenna may be selectively formed in the range of a length L of 0.5 mm to 2 mm in order to adjust a resonance frequency in the frequency band.

In a case in which the dielectric constant of the first block 120*a* is less than 3.5, in order for the chip antenna 100 to normally operate, a distance between the radiating portion 130*a* and the ground portion 130*b* needs to be increased. As a result of a test, in the case in which the dielectric constant of the first block 120*a* is less than 3.5, in order for the chip antenna 100 to operate in a frequency band of 20 GHz to 60 GHz, the chip antenna 100 was measured that it normally functions when the total width (W4+W1+W3) formed by the radiating portion 130*a*, the first block 120*a*, and the ground portion 130*b* is formed to be 2 mm or more. However, in a case in which the chip antenna is formed to be greater than 2 mm, since the total size of the chip antenna is increased, it is difficult for the chip antenna to be mounted in a thin portable device. In addition, in a case in which the dielectric constant of the first block 120*a* exceeds 25, the size of the chip antenna needs to be reduced to 0.3 mm or less, and in this case, it was measured that a performance of the antenna is lowered.

Therefore, in order to maintain the performance of the antenna while forming the total width (W4+W1+W3) to be 2 mm or less, in the present example, the first block 120*a* may be formed of a dielectric substance having the dielectric constant of 3.5 or more to 25 or less.

The second block 120*b* may be formed of the same material as the first block 120*a*. A width W2 of the second block 120*b* may be 50 to 60% of a width W1 of the first block 120*a*. In addition, a length L and a thickness t of the second block 120*b* may be the same as those of the first block. Therefore, the second block 120*b* may be the same material, the same length, and the same thickness as the first block 120*a*, and may have a difference only in the width.

However, according to an example, the second block 120*b* may be formed of a material different from the first block 120*a*. As an example, the second block 120*b* may be formed of a material having a dielectric constant different from that of the first block 120*a*. Specifically, the second block 120*b* may be formed of a material having a dielectric constant greater than that of the first block 120*a*.

The radiating portion 130*a* may have a first surface coupled to a first surface of the first block 120*a*. In addition, the ground portion 130*b* may be coupled to a second surface of the first block 120*a*. Here, the first surface and the second surface of the first block 120*a* refer to two surfaces opposing each other in opposite directions in the first block 120*a*, which may be formed as a hexahedron.

A second surface of the radiating portion 130*a* may be coupled to a first surface of the second block 120*b*, and the director 130*c* may be coupled to a second surface of the second block 120*b*. The first surface and the second surface of the second block 120*b* refer to two surfaces opposing each other in opposite directions in the second block 120*b*, which may be formed as a hexahedron.

In the present example, the width W1 of the first block 120*a* may be defined as a distance between the first surface and the second surface of the first block 120*a*. In addition, the width W2 of the second block 120*b* may be defined as a distance between the first surface and the second surface of the second block 120*b*. Therefore, a direction from the first surface to the second surface (or a direction from the second surface to the first surface) may be defined as a width direction of the first block 120*a* or the chip antenna. In addition, a width W3 of the ground portion 130*b*, a width W4 of the radiating portion 130*a*, and a width W5 of the director 130*c* may be defined as a distance of the chip antenna in the width direction. Accordingly, the width W4 of the radiating portion 130*a* refers to the shortest distance from a bonding surface of the radiating portion 130*a* bonded to the first surface of the first block 120*a* to a bonding surface with the second block 120*b*, and the width W3 of the ground portion 130*b* refers to the shortest distance from a bonding surface (a first surface) of the ground portion 130*b* bonded to the second surface of the first block 120*a* to an opposite surface of the bonding surface (a second surface). In addition, the width W5 of the director 130*c* refers to the shortest distance from a bonding surface of the director 130*c* bonded to the second block 120*b* to an opposite surface of the bonding surface.

The radiating portion 130*a* may be in contact with only one surface of six surfaces of the first block 120*a* and may be coupled to the first block 120*a*. The ground portion 130*b* may be in contact with only one surface of the six surfaces of the first block 120*a* and may be coupled to the first block 120*a*.

The radiating portion 130*a* and the ground portion 130*b* may not be disposed on other surfaces other than the first surface and the second surface of the first block 120*a*, and may be disposed in parallel while having the first block 120*a* interposed therebetween.

In a case in which the radiating portion 130*a* and the ground portion 130*b* are coupled to only the first surface and the second surface of the first block 120*a*, since the chip antenna has a capacitance due to the dielectric substance of the first block 120*a* between the radiating portion 130*a* and the ground portion 130*b*, a coupling antenna may be designed or a resonance frequency may be tuned.

The director 130*c* may be formed to have a same size as the radiating portion 130*a*, may be in contact with one surface of the six surfaces of the second block 120*b*, for example, the second surface, and may be coupled to the second block 120*b*. Therefore, the director 130*c* may be disposed to be spaced apart from the radiating portion 130*a* by the second block 120*b*, and may be disposed to be in parallel to the radiating portion 130*a*. Since the width W2 of the second block 120*b* is narrower than the width W1 of the first block 120*a*, the radiating portion 130*a* may be disposed to be more adjacent to the director 130*c* than to the ground portion 130*b*.

Referring to FIG. 1B, according to an example, the chip antenna may be implemented in a form in which the second block 120*b* and the director 130*c* are omitted. Hereinafter, the chip antenna according to the example described in FIG. 1A will be used for convenience of explanation. However, the description of the chip antenna according to the example of FIG. 1A may be applied to the chip antenna according to the example of FIG. 1B.

Figure 4A:
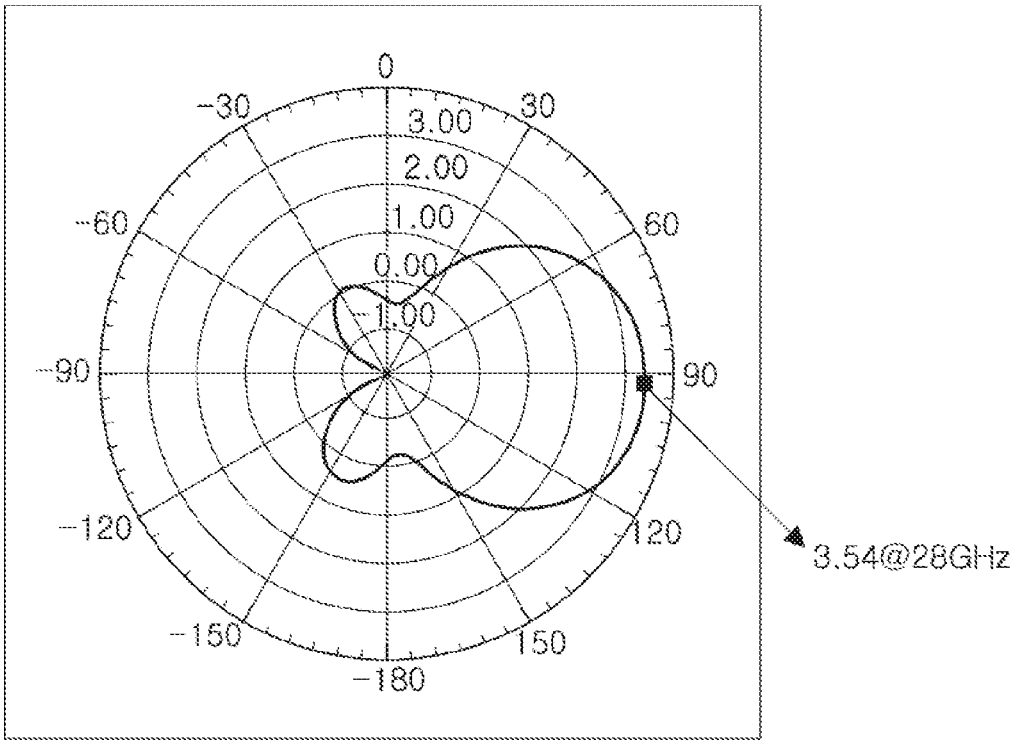
FIGS. 4A and 4B are graphs illustrating a measured radiation pattern of the chip antenna illustrated in FIG. 1A.
Figure 4B:
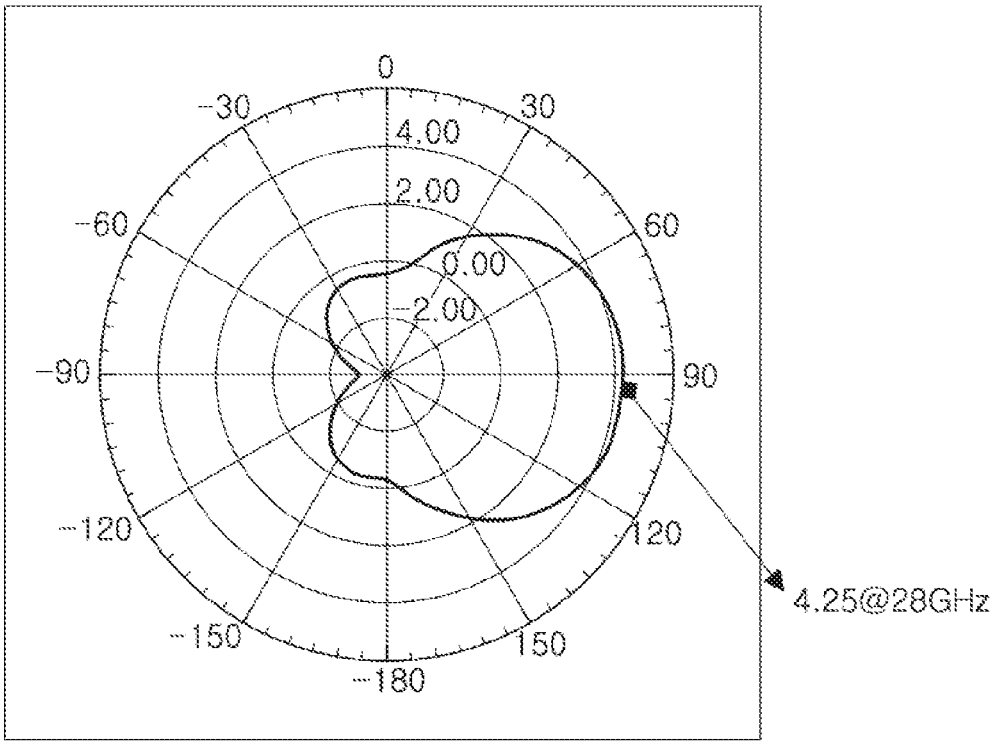

FIGS. 4A and 4B are graphs illustrating a measured radiation pattern of the chip antenna. FIG. 4A is a graph illustrating a measured radiation pattern of the chip antenna according to the example of FIG. 1B and FIG. 4B is a graph illustrating a measured radiation pattern of the chip antenna according to the example of FIG. 1A.

The chip antenna used in the present measurement may have the radiating portion 130*a*, the ground portion 130*b*, and the director 130*c* having the widths W3, W4, and W5, respectively, of 0.2 mm, the first block 120*a* having the width W1 of 0.6 mm, and the second block 120*b* having the width W2 of 0.3 mm and a thickness T of 0.5 mm.

Referring to FIG. 4A, the chip antenna according to the example of FIG. 1B may be 3.54 dBi at 28 GHz. Referring to FIG. 4B, the chip antenna according to the example of FIG. 1A may be 4.25 dBi at 28 GHz. That is, a gain is improved in the chip antenna according to the example of FIG. 1A as compared to the example of FIG. 1B. Therefore, in a case in which the chip antenna includes the director 130*c*, it may be seen that radiation efficiency is significantly increased.

It was measured that reflection loss S11 is decreased as the width W4 of the radiating portion 130*a* and the width W3 of the ground portion 130*b* are increased. In addition, it was measured that the reflection loss S11 is decreased at a high reduction rate in a section in which the width W4 of the radiating portion 130*a* and the width W3 of the ground portion 130*b* are 100 μm or less, and the reflection loss S11 is decreased at a relatively low reduction rate in a section in which the width W4 of the radiating portion 130*a* and the width W3 of the ground portion 130*b* exceed 100 μm. The width W4 of the radiating portion 130*a* and the width W3 of the ground portion 130*b* may be defined as 100 μm or more, respectively.

In a case in which the width W4 of the radiating portion 130*a* and the width W3 of the ground portion 130*b* are greater than the width W1 of the first block 120*a*, the radiating portion 130*a* and the ground portion 130*b* may be delaminated from the body portion 120 upon receiving an external impact or mounting on the substrate. Therefore, the maximum widths W4 and W3 of the radiating portion 130*a* and the ground portion 130*b* may be defined as 50% or less of the width W1 of the first block 120*a*.

In order to mount the chip antenna in a thin portable device, the total width (W4+W1+W3) formed by the radiating portion 130*a*, the first block 120*a*, and the ground portion 130*b* needs to be 2 mm or less as described above. In a case in which the radiating portion 130*a* and the ground portion 130*b* have the same width as each other, the maximum width of the radiating portion 130*a* or the ground portion 130*b* may be defined to be about 500 μm and the minimum width thereof may be defined to be 100 μm. However, the configuration of the chip antenna is not limited thereto, and when the widths of the radiating portion 130*a* and the ground portion 130*b* are different from each other, the maximum width described above may be changed.

Meanwhile, in a case in which the length L of the chip antenna 100 is increased, the reflection loss S11 may be reduced, but the resonance frequency may be lowered at the same time. Therefore, the length L of the chip antenna may be adjusted to optimize the resonance frequency or reduce the reflection loss S11.

The radiating portion 130*a*, the ground portion 130*b*, and the director 130*c* may all be formed of the same material. Referring to FIG. 3, the radiating portion 130*a*, the ground portion 130*b*, and the director 130*c* may include a first conductor 131 and a second conductor 132, respectively.

The first conductor 131 may be a conductor directly bonded to the first block 120*a* or the second block 120*b* and may be formed in a block form. The second conductor 132 may be formed in a form of a layer along a surface of the first conductor 131.

The first conductor 131 may be formed on the first block 120*a* or the second block 120*b* through a printing process or a plating process, and may be formed of an alloy of one or more selected from silver (Ag), gold (Au), copper (Cu), aluminum (Al), platinum (Pt), molybdenum (Mo), nickel (Ni), and tungsten (W). The first conductor 131 may also be formed of a conductive paste or a conductive epoxy having an organic material such as polymer, glass, and the like contained in a metal.

The second conductor 132 may be formed on the surface of the first conductor 131 through the plating process. The second conductor 132 may be formed by sequentially stacking a nickel (Ni) layer and a tin (Sn) layer, or sequentially stacking a zinc (Zn) layer and a tin (Sn) layer, but is not limited thereto. The first conductor 131 may be formed in the same thickness and the same height as the first block 120*a* and the second block 120*b*. Therefore, as illustrated in FIG. 3, a thickness t2 of the radiating portion 130*a*, the ground portion 130*b*, and the director 130*c* may be thicker than a thickness t1 of the first block 120*a* by virtue of the second conductor 132 formed on the surface of the first conductor 131.

The chip antenna 100 having the configuration as described above may be used in a high frequency band of 20 GHz or more to 60 GHz or less, and the total width (W4+W1+W3) formed by the radiating portion 130*a*, the first block 120*a*, and the ground portion 130*b*, or the total length L of the chip antenna 100 may be a size of 2 mm or less, such that the chip antenna 100 may be easily mounted in the thin portable device. In addition, since each of the radiating portion 130*a* and the ground portion 130*b* is in contact with only one surface of the first block 120*a*, the resonance frequency may be easily tuned. In addition, since the chip antenna 100 may include the director 130*c*, and the ground portion 130*b* performs a function of a reflector, beam linearity and gain may be improved, and the radiation efficiency may be increased.

A bonding part may be disposed between the first block 120*a* and the radiating portion 130*a*, and between the first block 120*a* and the ground portion 130*b*, respectively. In addition, the bonding part may be disposed between the second block 120*b* and the radiating portion 130*a*, and between the second block 120*b* and the director 130*c*, respectively.

The bonding part may bond the first conductor 131 and the body portion 120 to each other. Therefore, the radiating portion 130*a*, the ground portion 130*b*, and the director 130*c* may be bonded to the body portion 120 through the bonding part.

The bonding part may be provided to firmly couple the radiating portion 130*a*, the ground portion 130*b*, and the director 130*c* to the body portion 120. The bonding part may be formed of a material that may be easily bonded to the first conductors 131 of the radiating portion 130*a*, the ground portion 130*b*, and the director 130*c*, and the body portion 120.

For example, the bonding part may be formed of at least one of copper (Cu), titanium (Ti), platinum (Pt), molybdenum (Mo), tungsten (W), iron (Fe), silver (Ag), gold (Au), and chromium (Cr). In addition, the bonding part may be formed of any one of an Ag-paste, a Cu-paste, an Ag—Cu-paste, a Ni-paste, and a solder paste.

The bonding part may be formed of a material such as organic chemistry, glass, SiO2, and graphene or graphene oxide.

The bonding part may be formed as a single layer, and may be formed to have a thickness of 10 μm to 50 μm, for example. However, the bonding part is not limited to such a configuration, but may be variously modified. For example, the bonding part may be formed by stacking a plurality of layers. Meanwhile, the chip antenna is not limited to the configuration described above, but may be variously modified.

FIGS. 5 through 9 are perspective views illustrating chip antennas according to a modified examples of FIG. 1A.

Figure 5:
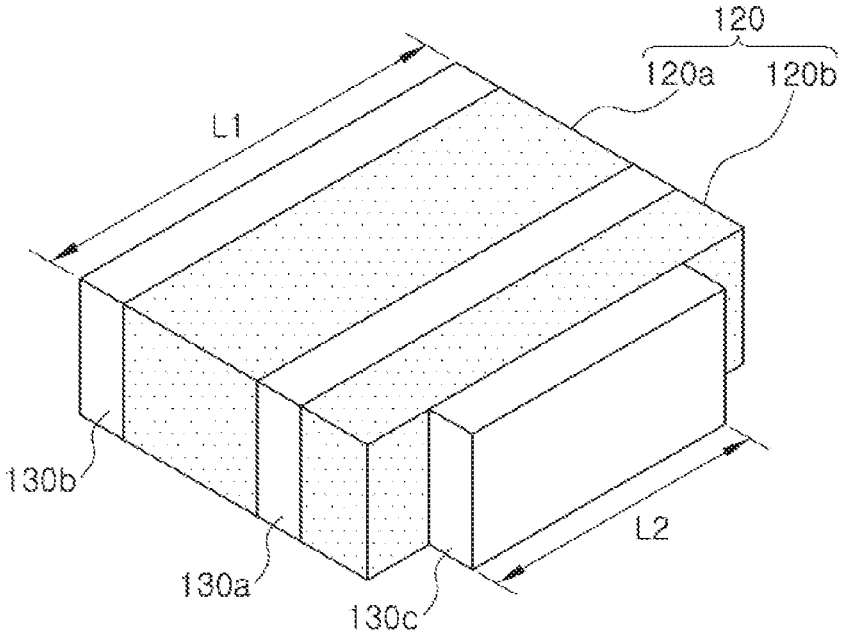
FIG. 5 is a perspective view illustrating a chip antenna according to a modified example.

In a chip antenna illustrated in FIG. 5, a length L2 of the director 130*c* may be shorter than a length L1 of the radiating portion 130*a*. For example, the length L2 of the director 130*c* may be 5% shorter than the length of the radiating portion 130*a*, but is not limited thereto. In this case, the center of the director 130*c* may be disposed on a straight line with the center of the radiating portion 130*a*.

Figure 6:
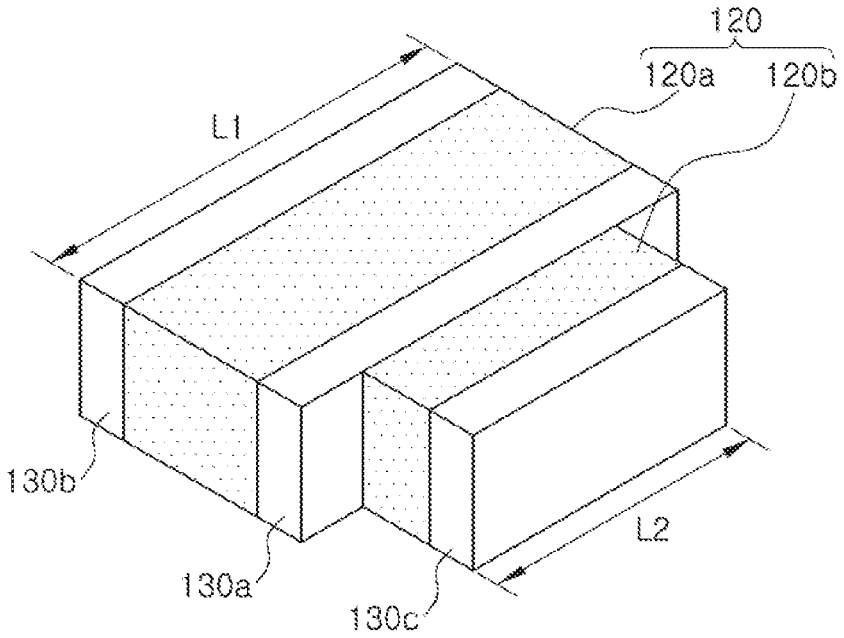
FIG. 6 is a perspective view illustrating a chip antenna according to a modified example.

In the chip antenna illustrated in FIG. 6, the second block 120*b*, together with the director 130*c*, may have a length shorter than the length L1 of the radiating portion 130*a*. The second block 120*b* may have the same length L2 as the director 130*c*. The director 130*c* and the second block 120*b* may be 5% shorter than the length of the radiating portion 130*a*, but are not limited thereto. For example, the second block 120*b* may be formed to be longer or shorter than the director 130*c*, and various modifications are possible.

Figure 7:
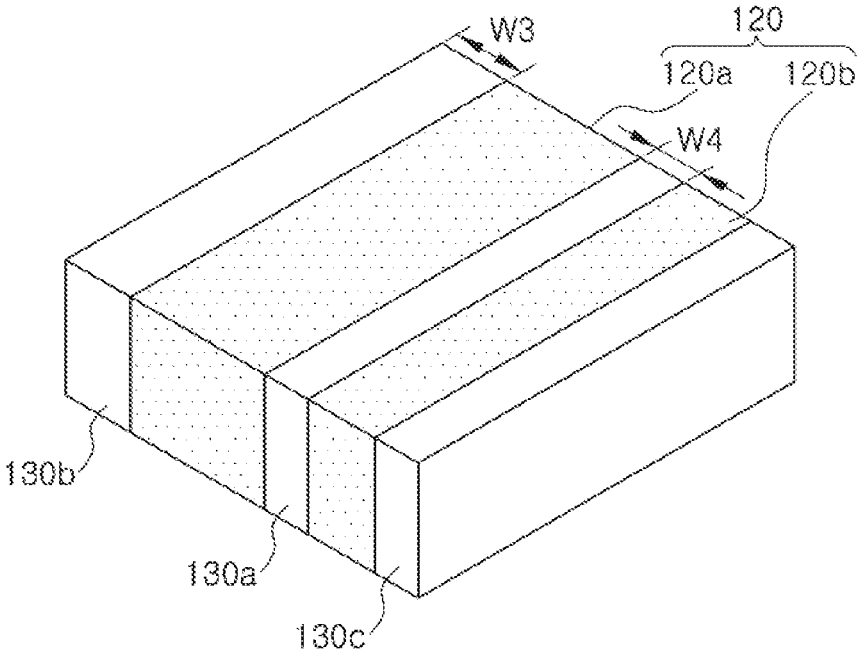
FIG. 7 is a perspective view illustrating a chip antenna according to a modified example.

In a chip antenna illustrated in FIG. 7, the width W3 of the ground portion 130*b* may be greater than the width W4 of the radiating portion 130*a*. Since the ground portion 130*b* serves as a reflector, an effect that a length is extended may be obtained by increasing the width W3 of the ground portion 130*b*.

The chip antenna may have a structure similar to that of a Yagi-Uda antenna. Therefore, similarly to the Yagi-Uda antenna, the radiating portion 130*a* functioning as a radiation machine may radiate electromagnetic waves, and the director 130*c* may radiate electromagnetic waves induced by the electromagnetic waves radiated from the radiating portion 130*a*. In this case, a wavelength formed by the radiating portion 130*a* and the director 130*c* due to a phase difference may cause constructive interference, thereby increasing the gain of the antenna. In addition, the electromagnetic waves radiated on an opposite side (in the direction of the ground portion) of the radiating portion 130*a* may be reflected toward the director 130*c* by the ground portion 130*b* serving as the reflector to thereby increase radiation efficiency.

In a typical Yagi-Uda antenna, the reflector is longer than the radiation machine. However, since the size of the chip antenna according to the example is limited, the width W3 of the ground portion 130*b* may be greater than the width W4 of the radiating portion 130*a*. For example, the width W3 of the ground portion 130*b* may be 150% of the width W4 of the radiating portion 130*a*, but is not limited to such dimensions.

Figure 8:
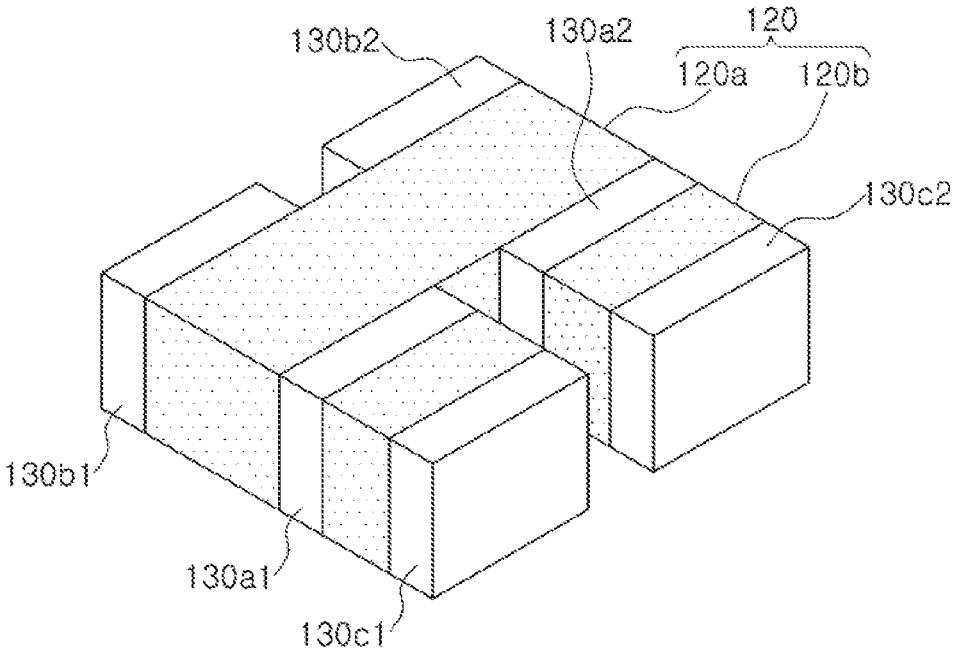
FIG. 8 is a perspective view illustrating a chip antenna according to a modified example.

In a chip antenna illustrated in FIG. 8, the ground portion may include a first ground portion 130*b*1 and a second ground portion 130*b*2 which are disposed to be spaced apart from each other. The radiating portion may include a first radiating portion 130*a*1 and a second radiating portion 130*a*2 which are disposed to be spaced apart from each other, and the director may also include a first director 130*c*1 and a second director 130*c*2 which are disposed to be spaced apart from each other.

The first ground portion 130*b*1, the first radiating portion 130*a*1, and the first director 130*c*1 may all be disposed on a straight line. Similarly, the second ground portion 130*b*2, the second radiating portion 130*a*2, and the second director 130*c*2 may all be disposed on a straight line. The chip antenna having the configuration as described above may implement a dipole antenna structure in one chip antenna.

Figure 10:
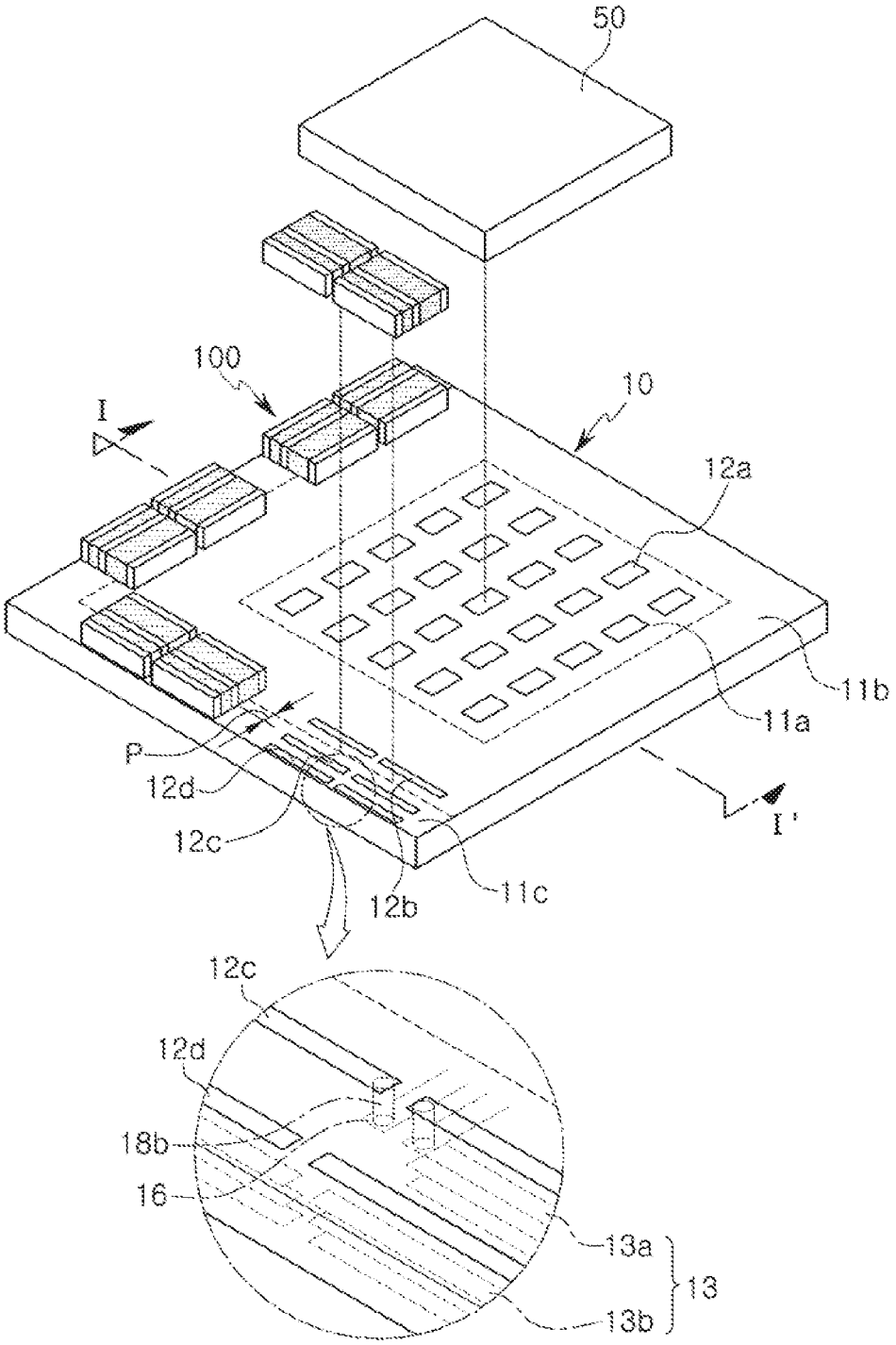
FIG. 10 is a partially exploded perspective view of a chip antenna module including the chip antenna illustrated in FIG. 1A.

As illustrated in FIG. 10, in order to configure the dipole antenna structure, only one chip antenna, not two chip antennas may be used.

In example of FIG. 8, the first block 120*a* is configured in one body, but the second block 120*b* may be divided into two portions and disposed between the first radiating portion 130*a*1 and the first director 130*c*1, and between the second radiating portion 130*a*2 and the second director 130*c*2, respectively. However, the configuration is not limited thereto, and the second block may be variously modified. For example, the second block may be configured in one body as a second block of FIG. 9 to be described below.

Similar to the examples illustrated in FIGS. 5 and 6, lengths of the first director 130*c*1 and the second director 130*c*2 may be shorter than the first radiating portion 130*a*1 and the second radiating portion 130*a*2, respectively.

Figure 9:
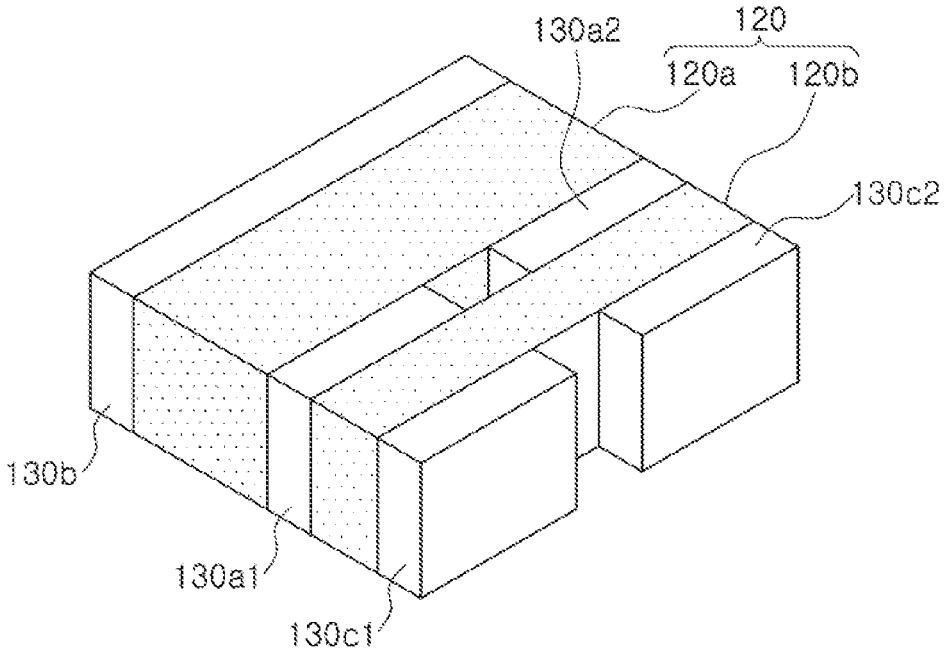
FIG. 9 is a perspective view illustrating a chip antenna according to a modified example.

In the chip antenna illustrated in FIG. 9, the radiating portion may include the first radiating portion 130*a*1 and the second radiating portion 130*a*2 which are disposed to be spaced apart from each other, and the director may include the first director 130*c*1 and the second director 130*c*2 which are disposed to be spaced apart from each other. In addition, the ground portion 130*b* may be configured in one body.

The first block 120*a* may be configured in one body and disposed between the radiating portions 130*a*1 and 130*a*2 and the ground portion 130*b*, and the second block 120*b* may also be configured in one body and disposed between the radiating portions 130*a*1 and 130*a*2 and the directors 130*c*1 and 130*c*2.

In the chip antenna having the configuration as described above, since the length of the ground portion 130*b* is longer than the lengths of the radiating portions 130*a*1 and 130*a*2, reflection efficiency of the electromagnetic waves may be increased.

Similar to the examples illustrated in FIGS. 5 and 6, lengths of the first director 130*c*1 and the second director 130*c*2 may be shorter than the first radiating portion 130*a*1 and the second radiating portion 130*a*2, respectively.

Figure 11:
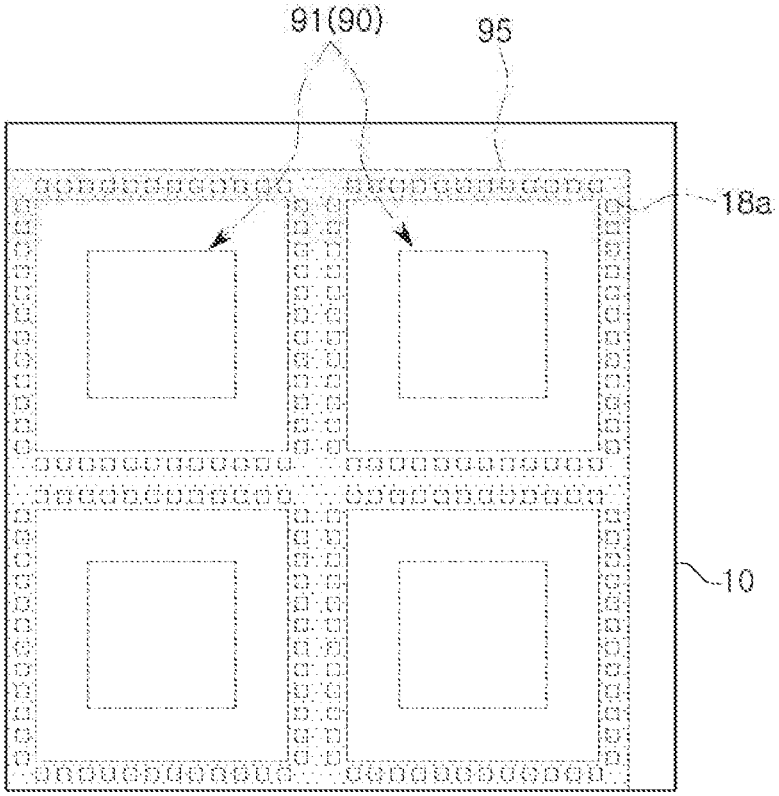
FIG. 11 is a bottom view of the chip antenna module illustrated in FIG. 10.

FIG. 10 is a partially exploded perspective view of a chip antenna module including the chip antenna illustrated in FIG. 1A and FIG. 11 is a bottom view of the chip antenna illustrated in FIG. 10. In addition, FIG. 12 is a cross-sectional view taken along a line I-I' of FIG. 10.

Figure 12:
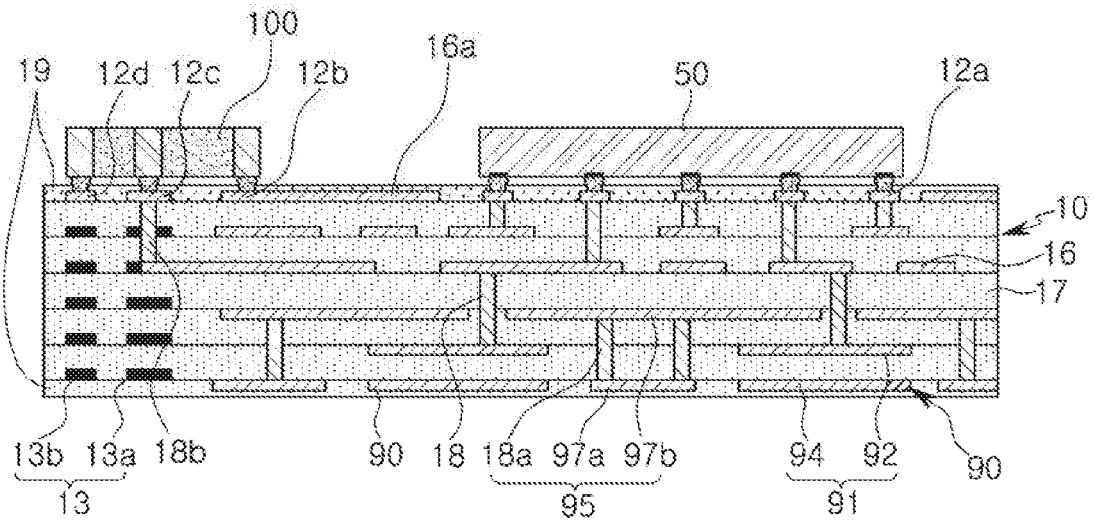
FIG. 12 is a cross-sectional view taken along line I-I' of FIG. 10.

Referring to FIGS. 10 through 12, a chip antenna module 1 may include a substrate 10, an electronic element 50, and a chip antenna 100.

The substrate 10 may be a circuit board on which a circuit or an electronic component necessary for a wireless antenna is mounted. For example, the substrate 10 may be a printed circuit board (PCB) having one or more electronic components accommodated therein or having one or more electronic components mounted on a surface thereof. The substrate 10 may include circuit wirings that electrically connect the electronic components to each other.

The substrate 10 may be a multilayer substrate formed by repeatedly stacking a plurality of insulating layers and a plurality of wiring layers. However, the substrate 10 may be a double-sided substrate in which the wiring layers are formed on opposite surfaces of one insulating layer.

As the substrate 10, various kinds of substrates (for example, a printed circuit board, a flexible substrate, a ceramic substrate, a glass substrate, and the like) well known in the art may be used.

A first surface, which is an upper surface of the substrate 10, may be divided into an element mounting portion 11*a*, a ground region 11*b*, and a feeding region 11*c*.

The element mounting portion 11*a*, which is a region on which the electronic element 50 is mounted, may be disposed in the ground region 11*b*. A plurality of connection pads 12*a* to which the electronic element 50 is electrically connected may be disposed on the element mounting portion 11*a*.

The ground region 11*b*, which is a region on which the ground layer is disposed, may be disposed to surround the element mounting portion 11*a*. The element mounting portion 11*a* may be formed in a quadrangular shape. Therefore, the ground region 11*b* may be disposed to surround the element mounting portion 11*a*.

As the ground region 11*b* is disposed along a periphery of the element mounting portion 11*a*, the connection pads 12*a* of the element mounting portion 11*a* may be electrically connected to external or other components through interlayer connection conductors 18 penetrating through the insulating layer of the substrate 10.

A plurality of ground pads 12*b* may be formed in the ground region 11*b*. In a case in which the ground layer is disposed on the uppermost wiring layer, the ground pads 12*b* may be formed by partially opening an insulating protective layer 19 covering the ground layer. However, the configuration is not limited thereto, and in a case in which the ground layer is disposed between other wiring layers other than the uppermost wiring layer, the ground pads 12*b* may be disposed on the uppermost wiring layer, and the ground pads 12*b* and the ground layer may be connected to each other by the interlayer connection conductors 18. The ground pad 12*b* may be disposed to be paired with a feeding pad 12*c* to be described below. Therefore, the ground pad 12*b* may be disposed at a position adjacent to the feeding pad 12*c*.

The feeding region 11*c* may be disposed outside of the ground region 11*b*. The feeding region 11*c* may be formed outside of two sides of the ground region 11*b*. The feeding region 11*c* may be disposed along an edge of the substrate. However, the configuration of the chip antenna module is not limited thereto.

A plurality of feeding pads 12*c* and a plurality of dummy pads 12*d* may be disposed on the feeding region 11*c*. The feeding pads 12*c* may be disposed on the uppermost wiring layer similarly to the connection pads 12*a*, and may be electrically connected to the electronic element 50 or other components through the interlayer connection conductors 18 penetrating through an insulating layer 17, in particular, feeding vias 18*b*.

The plurality of dummy pads 12*d* may be disposed on the uppermost wiring layer similarly to the feeding pads 12*c*. However, the dummy pads 12*d* may not be electrically connected to the other components of the substrate and may be bonded to the director 130*c* of the chip antenna 100 mounted on the substrate 10.

The dummy pads 12*d* may not be configured to electrically connect the director 130*c* and the circuit in the substrate 10, but may be provided to firmly bond the chip antenna 100 to the substrate 10. The dummy pads 12*d* may be omitted if the chip antenna 100 may be firmly fixed to the substrate 10 by only the feeding pads 12*c* and the ground pad 12*b*. In this case, the director 130*c* may be in contact with the substrate 10, but may not be electrically connected to the substrate 10.

An auxiliary patch 13 may be provided on an inner layer of the substrate 10. The auxiliary patch 13 may include at least one of a first auxiliary patch 13*a* provided below the feeding pad 12*c*, that is, provided below the radiating portion 130*a*, and a second auxiliary patch 13*b* provided below the dummy pad 12*d*, that is, provided below the director 130*c*. The first auxiliary patch 13*a* may be formed so as to correspond to the radiating portion 130*a* in a lower portion of a mounting direction of the chip antenna 100, and the second auxiliary patch 13*b* may be formed so as to correspond to the director 130*c* in the lower portion of the mounting direction of the chip antenna 100.

The chip antenna according to the example of FIG. 1A may include at least one of the first auxiliary patch 13*a* and the second auxiliary patch 13*b*. The chip antenna according to the example of FIG. 1B may include the first auxiliary patch 13*a*, or may not include the first auxiliary patch 13*a*. That is, the chip antenna according to the example of FIG. 1B may selectively include the first auxiliary patch 13*a*.

At least one first auxiliary patch 13*a* may be provided on at least one of the plurality of inner layers of the substrate 10. As an example, the first auxiliary patch 13*a* may have the same or similar length as the radiating portion 130*a*. However, the first auxiliary patch 130*a* is not limited to such a configuration. According to an example, the first auxiliary patch 13*a* may be formed to be shorter than the radiating portion 130*a*, or may be alternatively formed longer than the radiating portion 130*a*.

The first auxiliary patch provided on the same layer as a wiring layer 16 connected to the feeding via 18*b* among the first auxiliary patches 13*a* may be formed to be partially spaced apart from the wiring layer 16. However, the first auxiliary patch provided on the same layer as the wiring layer 16 connected to the feeding via 18*b* among the first auxiliary patches 13*a* may be formed to be connected to the wiring layer 16.

The chip antenna module may improve radiation characteristics of the radiating portion 130*a* connected to the feeding pads 12*c* by providing the first auxiliary patches 13*a* below the feeding pads 12*c*.

At least one second auxiliary patch 13*b* may be provided on at least one of the plurality of inner layers of the substrate 10. As an example, the second auxiliary patch 13*b* may have the same or similar length as the director 130*c*. However, the second auxiliary patch 130*b* is not limited to such a configuration. The second auxiliary patch 13*b* may be formed to be shorter than the director 130*c*, or may be alternatively formed longer than the director 130*c*.

The chip antenna module may improve radiation characteristics of the director 130*c* connected to the dummy pads 12*d* by providing the second auxiliary patches 13*b* below the dummy pads 12*d*.

The first auxiliary patch 13*a* and the second auxiliary patch 13*b* may be provided on the same layer of the substrate 10. Balanced and stable radiation characteristics may be secured by providing the first auxiliary patch 13*a* and the second auxiliary patch 13*b* that respectively assist the radiation characteristics of the radiating portion 130*a* and the director 130*c* on the same layer. However, the first auxiliary patch 13*a* and the second auxiliary patch 13*b* may be provided on different layers of the substrate 10. Also, some of the first auxiliary patches 13*a* and some of the second auxiliary patches 13*b* may be provided on the same layer and the rest of the first auxiliary patches 13*a* and the rest of the second auxiliary patches 13*b* may be provided on different layers.

FIGS. 13A through 13D are enlarged views of a first auxiliary patch according to various examples.

Hereinafter, for convenience of explanation, it is assumed that the plurality of first auxiliary patches 13*a* includes five first auxiliary patches 13*a*1 to 13*a*5.

Figure 13A:
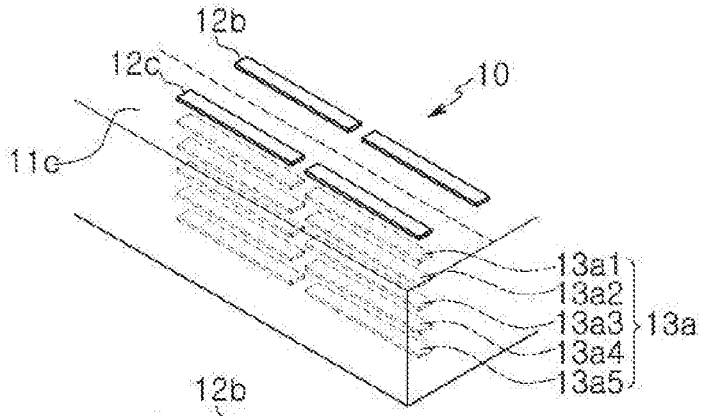
FIGS. 13A, 13B, 13C, and 13D are enlarged views of a first auxiliary patch according to various examples.

Referring to FIG. 13A, the plurality of first auxiliary patches 13*a*1, 13*a*2, 13*a*3, 13*a*4, and 13*a*5 may be provided on different layers of the substrate 10.

The plurality of first auxiliary patches 13*a*1 to 13*a*5 provided on different layers may be connected to each other by first auxiliary vias extending in a thickness direction of the substrate 10.

The first auxiliary vias may be connected to some first auxiliary patches of the first auxiliary patches 13*a*1 to 13*a*5 and be separated from the remaining first auxiliary patches, such that some first auxiliary patches of the plurality of first auxiliary patches 13*a*1 to 13*a*5 may be electrically connected to each other and the remaining first auxiliary patches may be electrically separated from each other.

The first auxiliary vias may be extended toward an upper surface of the substrate 10 and may be connected to the wiring layer 16 or the feeding pad 12*c* connected to the feeding via 18*b*. Therefore, the first auxiliary via connected to the first auxiliary patch 13*a* may be electrically connected to the radiating portion 130*a*. However, the first auxiliary via connected to the first auxiliary patch 13*a* may be electrically separated from the radiating portion 130*a*.

At least one first auxiliary via may be provided. When one first auxiliary via is provided, one first auxiliary via may be disposed in a central region of the plurality of first auxiliary patches 13*a*1 to 13*a*5 in a length direction thereof. When two first auxiliary patches are provided, the two first auxiliary vias may be disposed in different edge regions of the plurality of first auxiliary patches 13*a*1 to 13*a*5 in the length direction thereof. In addition, when three or more first auxiliary vias are provided, the three or more first auxiliary vias may be spaced apart from each other along the length direction of the plurality of first auxiliary patches 13*a*1 to 13*a*5 and may be disposed at equal intervals, for example. However, the number and positions of the first auxiliary vias may be variously changed.

Figure 13B:
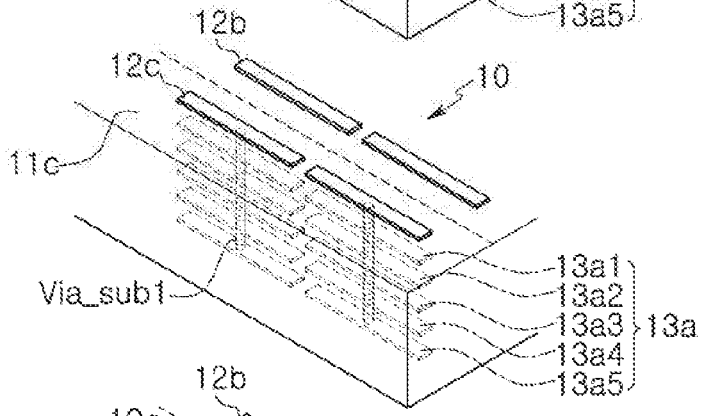

More specifically, referring to FIG. 13B, the plurality of first auxiliary patches 13*a*1 to 13*a*5 provided on different layers may be connected to each other by one first auxiliary via Via_sub1 extending in the thickness direction of the substrate 10. One first auxiliary via Via_sub1 may be disposed in the central region of the plurality of first auxiliary patches 13*a*1 to 13*a*5 in the length direction thereof.

Figure 13C:
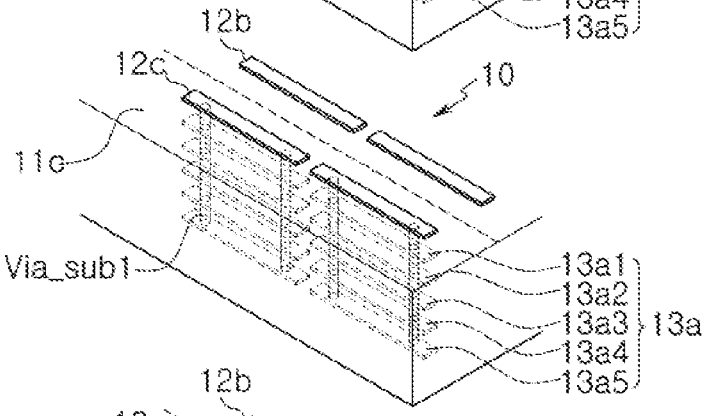

Referring to FIG. 13C, the plurality of first auxiliary patches 13*a*1 to 13*a*5 may be connected to each other by two first auxiliary vias Via_sub1. The two first auxiliary vias Via_sub1 may be disposed in different edge regions of the plurality of first auxiliary patches 13*a*1 to 13*a*5 in the length direction thereof.

Figure 13D:
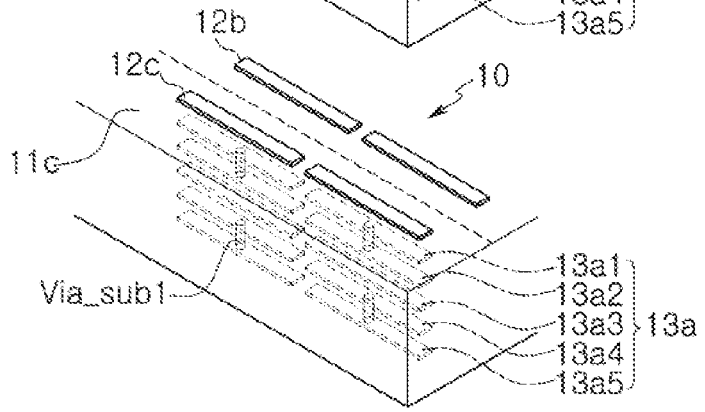

Referring to FIG. 13D, a 1-1-th auxiliary patch 13*a*1 and a 1-2-th auxiliary patch 13*a*2 of the plurality of first auxiliary patches 13*a*1 to 13*a*5 may be connected to each other by the first auxiliary via Via_sub1, and a 1-4-th auxiliary patch 13*a*4 and a 1-5-th auxiliary patch 13*a*5 may be connected to each other by the first auxiliary via Via_sub1. A 1-3-th auxiliary patch 13*a*3 may be separated from the first auxiliary via Via_sub1 and may be electrically separated from the remaining first auxiliary patches.

FIGS. 14A through 14D are enlarged views of a second auxiliary patch according to various examples.

Hereinafter, for convenience of explanation, it is assumed that the plurality of second auxiliary patches 13*b* includes five second auxiliary patches 13*b*1, 13*b*2, 13*b*3, 13*b*4, and 13*b*5.

Figure 14A:
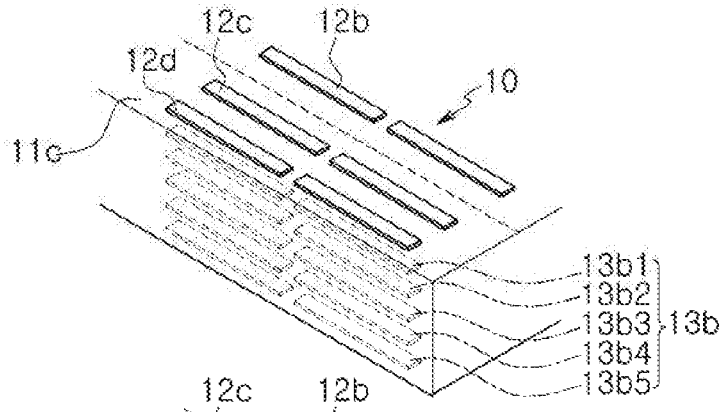
FIGS. 14A, 14B, 14C, and 14D are enlarged views of a second auxiliary patch according to various examples.

Referring to FIG. 14A, the plurality of second auxiliary patches 13*b*1 to 13*b*5 may be provided on different layers of the substrate 10.

The plurality of second auxiliary patches 13*b*1 to 13*b*5 provided on different layers may be connected to each other by second auxiliary vias extending in the thickness direction of the substrate 10.

The second auxiliary vias may be connected to some second auxiliary patches of the second auxiliary patches 13*b*1 to 13*b*5 and be separated from the remaining second auxiliary patches, such that some second auxiliary patches of the plurality of second auxiliary patches 13*b*1 to 13*b*5 may be electrically connected to each other and the remaining second auxiliary patches may be electrically separated from each other.

The second auxiliary vias may be extended toward the upper surface of the substrate 10 and may be connected to the dummy pads 12*d*. Therefore, the second auxiliary via connected to the second auxiliary patch 13*b* may be electrically connected to the director 130*c*. However, the second auxiliary via connected to the second auxiliary patch 13*b* may be electrically separated from the director 130*c*.

At least one second auxiliary via may be provided. When one second auxiliary via is provided, one second auxiliary via may be disposed in a central region of the plurality of second auxiliary patches 13*b*1 to 13*b*5 in a length direction thereof. When two second auxiliary patches are provided, the two second auxiliary vias may be disposed in different edge regions of the plurality of second auxiliary patches 13*b*1 to 13*b*5 in the length direction thereof. In addition, when three or more second auxiliary vias are provided, the three or more second auxiliary vias may be spaced apart from each other along the length direction of the plurality of second auxiliary patches 13*b*1 to 13*b*5 and may be disposed at equal intervals, for example. However, the number and positions of the second auxiliary vias may be variously changed.

Figure 14B:
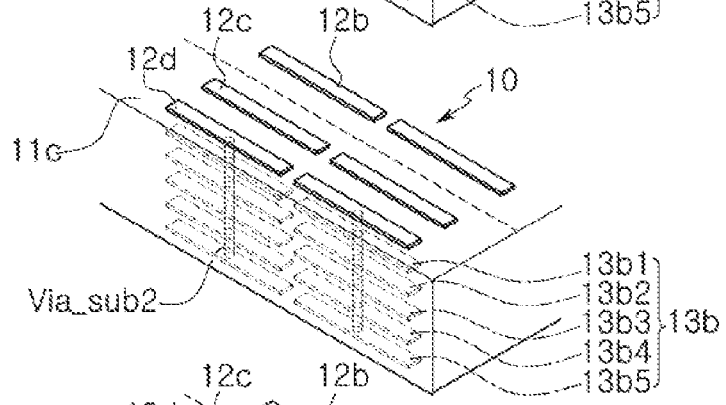

More specifically, referring to FIG. 14B, the plurality of second auxiliary patches 13*b*1 to 13*b*5 provided on different layers may be connected to each other by one second auxiliary via Via_sub2 extending in the thickness direction of the substrate 10. One second auxiliary via Via_sub2 may be disposed in the central region of the plurality of second auxiliary patches 13*b*1 to 13*b*5 in the length direction thereof.

Figure 14C:
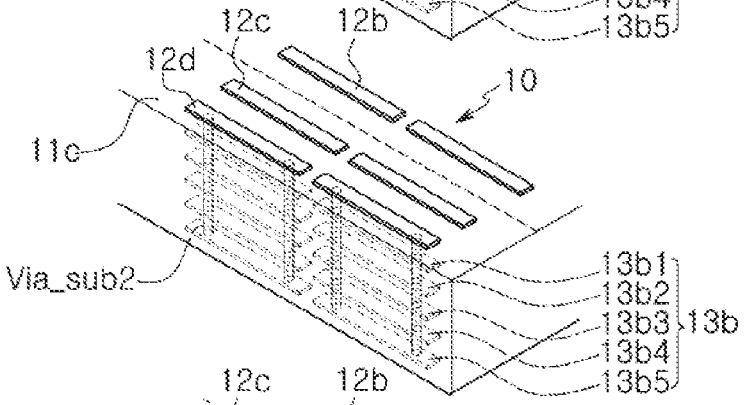

Referring to FIG. 14C, the plurality of second auxiliary patches 13*b*1 to 13*b*5 may be connected to each other by two second auxiliary vias Via_sub2. The two second auxiliary vias Via_sub2 may be disposed in different edge regions of the plurality of second auxiliary patches 13*b*1 to 13*b*5 in the length direction thereof.

Figure 14D:
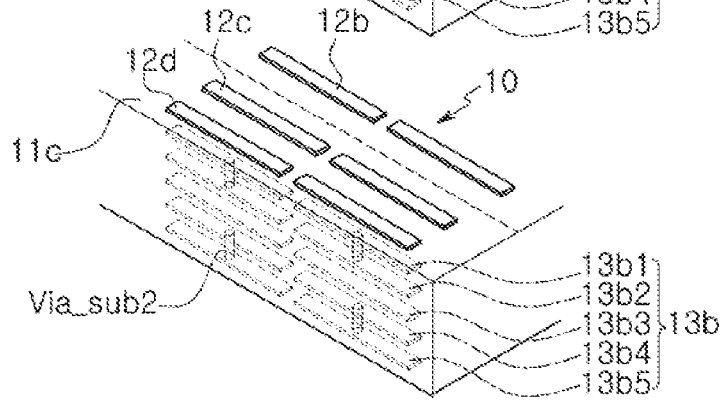

Referring to FIG. 14D, a 1-1-th auxiliary patch 13*b*1 and a 1-2-th auxiliary patch 13*b*2 of the plurality of second auxiliary patches 13*b*1 to 13*b*5 may be connected to each other by the second auxiliary via Via_sub2, and a 1-4-th auxiliary patch 13*b*4 and a 1-5-th auxiliary patch 13*b*5 may be connected to each other by the second auxiliary via Via_sub2. The 1-3-th auxiliary patch 13*b*3 may be separated from the second auxiliary via Via_sub2 and may be electrically separated from the remaining second auxiliary patches.

The element mounting portion 11*a*, the ground region 11*b*, and the feeding region 11*c* having the configuration as described above may be divided by the shape and position of the ground layer 16*a* thereon, and may be protected by an insulating protective layer disposed to be stacked on the uppermost insulating layer. The connection pad 12*a*, the ground pad 12*b*, the feeding pad 12*c*, and the dummy pad 12*d* may be exposed to the outside in the form of a pad through an opening from which the insulating protective layer 19 is removed.

The feeding pad 12*c* may be formed to have the same or similar length as the lower surface (or bonding surface) of the radiating portion 130*a*. However, an area of the feeding pad 12*c* may be formed to be half or less of an area of the lower surface (or bonding surface) of the radiating portion 130*a* of the chip antenna 100. In this case, the feeding pad 12*c* may be formed in a point shape rather than a line and may not be bonded to the entire lower surface of the radiating portion 130*a*, but be bonded to only a portion of the lower surface of the radiating portion 130*a*. In addition, similarly, the dummy pad 12*d* may be formed to have the same or similar length as the director 130*c*, or may alternatively have different lengths.

A patch antenna 90 may be disposed in the substrate 10 or on the second surface thereof, which is the lower surface thereof. The patch antenna 90 may be configured by the wiring layer 16 provided on the substrate 10. However, the patch antenna 90 is not limited thereto.

Referring to FIGS. 11 and 12, the patch antenna 90 may include a feeding part 91 having a feeding electrode 92 and a no-feeding electrode 94.

The patch antenna 90 may have a plurality of feeding parts 91 dispersedly disposed on the second surface side of the substrate 10. Four feeding parts 91 may be provided, but the number of the feeding parts 91 is not limited to four.

The patch antenna 90 may be configured so that a portion (e.g., the no-feeding electrode) thereof is disposed on the second surface of the substrate 10. However, the patch antenna 90 is not limited to such a configuration and may be variously modified. For example, the entirety of the patch antenna 90 may be disposed in the substrate 10.

The feeding electrode 92 may be formed of a metal layer of a flat piece form having a predetermined area and may be configured by one conductor plate. The feeding electrode 92 may have a polygonal structure and may be formed in a quadrangular shape. However, the feeding electrode 92 may be variously modified. For example, the feeding electrode 92 may be formed in a circular shape.

The feeding electrode 92 may be connected to the electronic element 50 through the interlayer connection conductor 18. In this case, the interlayer connection conductor 18 may penetrate through a second ground layer 97*b* to be described below and may be connected to the electronic element 50.

The no-feeding electrode 94 may be formed of one flat conductor plate disposed to be spaced apart from the feeding electrode 92 by a predetermined distance and having a predetermined area. The no-feeding electrode 94 may have the same or similar area as the feeding electrode 92. The no-feeding electrode 94 may be formed to have an area wider than that of the feeding electrode 92 and may be disposed to face the entirety of the feeding electrode 92.

The no-feeding electrode 94 may be disposed on the surface side of the substrate 10 rather than the feeding electrode 92, and may serve as the director. Therefore, the no-feeding electrode 94 may be disposed on the wiring layer 16 disposed on the lowest portion of the substrate 10. In this case, the no-feeding electrode 94 may be protected by the insulating protective layer 19 disposed on the lower surface of the insulating layer 17.

The substrate 10 may have a ground structure 95. The ground structure 95 may be disposed around the feeding part 91 and configured in the form of a container having the feeding part 91 accommodated therein. To this end, the ground structure 95 may include a first ground layer 97*a*, the second ground layer 97*b*, and a ground via 18*a*.

Referring to FIG. 12, the first ground layer 97*a* may be disposed on the same plane as the no-feeding electrode 94, and may be disposed around the no-feeding electrode 94 and may surround the no-feeding electrode 94. In this case, the first ground layer 97*a* may be disposed to be spaced apart from the no-feeding electrode 94 by a predetermined distance.

The second ground layer 97*b* may be disposed on the wiring layer 16 different from the first ground layer 97*a*. For example, the second ground layer 97*b* may be disposed between the feeding electrode 92 and the first surface of the substrate 10. In this case, the feeding electrode 92 may be disposed between the no-feeding electrode 94 and the second ground layer 97*b*.

The second ground layer 97*b* may be entirely disposed on the corresponding wiring layer 16, and may be partially removed only at the portion at which the interlayer connection conductor 18 connected to the feeding electrode 92 is disposed.

The ground via 18*a* may be an interlayer connection conductor electrically connecting the first ground layer 97*a* and the second ground layer 97*b* to each other. A plurality of ground vias 18*a* may be disposed to surround the feeding part 91 along a periphery of the feeding part 91. The ground vias 18*a* are disposed in one column as an example, but may be variously configured. For example, the ground vias 18*a* may be disposed in a plurality of columns.

According to the configuration as described above, the feeding part 91 may be disposed in the ground structure 95 formed in the container shape by the first ground layer 97*a*, the second ground layer 97*b*, and the ground vias 18*a*. In this case, the plurality of ground vias 18*a* disposed in a line may define side surfaces of the container shape described above.

Each of the feeding parts 91 may be disposed in the container shape. Therefore, interference between the respective feeding parts 91 may be blocked by the ground structure 95. For example, noise transmitted along a horizontal direction of the substrate 10 may be blocked by the side surface of the container shape formed by the plurality of ground vias 18*a*.

As the ground vias 18*a* form the side surfaces of a cavity, the feeding part 91 may be isolated from other, adjacent feeding parts 91. Since the ground structure 95 of the container shape serves as the reflector, radiation characteristics of the patch antenna 90 may be increased.

The feeding part 91 of the patch antenna 90 having the configuration as described above may radiate a radio signal in the thickness direction (e.g., a lower direction) of the substrate 10.

Referring to FIG. 12, the first ground layer 97*a* and the second ground layer 97*b* may not be disposed in a region facing a feeding region (11*c* in FIG. 11) defined on the first surface of the substrate 10. This is for the purpose of significantly reducing interference between the radio signal radiated from the chip antenna to be described below and the ground structure 95, but the first ground layer 97*a* and the second ground layer 97*b* are not limited to such a configuration.

This example describes a case in which the patch antenna 90 includes the feeding electrode 92 and the no-feeding electrode 94, but the patch antenna 90 may be variously configured. For example, the patch antenna 90 may include only the feeding electrode 92.

The patch antenna 90 having the configuration as described above may radiate a radio signal in the thickness direction of the substrate 10 (e.g., a direction perpendicular to the substrate).

The electronic element 50 may be mounted on the element mounting portion 11*a* of the substrate 10. A plurality of electronic elements may also be mounted on the substrate 10.

The electronic element 50 may include at least one active element, and may include, for example, a signal processing element of applying the radiation signal to the feeding part of the antenna. The electronic element 50 may also include a passive element.

As the chip antenna 100, any one of the chip antennas according to the examples described above may be used, and the chip antenna 100 may be mounted on the substrate 10 through a conductive adhesive such as a solder or the like.

In the chip antenna 100 according to the examples, the ground portion 130*b* may be mounted on the ground region 11*b*, and the radiating portion 130*a* and the director 130*c* may be mounted on the feeding region 11*c*. More specifically, the ground portion 130*b*, the radiating portion 130*a*, and the director 130*c* of the chip antenna 100 may be bonded to and mounted on the ground pads 12*b*, the feed pads 12*c*, and the dummy pads 12*d* of the substrate 10, respectively.

The chip antenna module according to the examples may radiate a horizontal polarized wave using the chip antenna, and may radiate a vertical polarized wave using the patch antenna. That is, the chip antennas may be disposed at positions adjacent to the edges of the substrate to radiate radio waves in the plane direction of the substrate (e.g., the horizontal direction of the substrate), and the patch antenna may be disposed on the second surface of the substrate to radiate the radio waves in the thickness direction of the substrate (e.g., the vertical direction of the substrate). Therefore, radiation efficiency of the radio waves may be increased. In addition, in the chip antenna module according to the examples, the two chip antennas disposed in pairs may serve as a dipole antenna.

The two chip antennas 100 disposed in pairs may be disposed to be spaced apart from each other and may provide one dipole antenna structure. Here, a spaced distance between the two chip antennas 100 may be 0.2 mm to 0.5 mm. In a case in which the spaced distance is less than 0.2 mm, interference may occur between the two chip antennas, and in a case in which the space distance is 0.5 mm or more, the function as the dipole antenna may be degraded.

It may also be considered that the dipole antenna is configured using the wiring layer of the substrate instead of the chip antenna. However, in this case, since a length of a radiating portion of the dipole antenna is formed to be a half wavelength length of a corresponding frequency, the feeding region in which the dipole antenna is disposed occupies a relatively large size on the substrate.

On the other hand, when the chip antenna is used as in the present examples, the size of the chip antenna may be significantly reduced through a dielectric constant (e.g., 10 or more) of the first block.

For example, in a case in which the dipole antenna is formed on the first surface of the substrate using the wiring pattern, the feeding line of the dipole antenna needs to be disposed to be spaced apart from the ground region by 1 mm or more. On the other hand, when the chip antenna is applied, the feeding pad may be designed to be spaced apart from the ground region by 1 mm or less.

Therefore, a size of the feeding region may be reduced as compared to the case of using the dipole antenna, and an overall size of the chip antenna module may be significantly reduced.

Meanwhile, in a case in which a spaced distance P between the radiating portion of the chip antenna 100 and the ground region 11*b* is less than 0.2 mm, the resonance frequency of the chip antenna 100 may be changed. Therefore, the radiating portion 130*a* of the chip antenna 100 and the ground region 11*b* of the substrate 10 may be spaced apart from each other in the range of 0.2 mm or more to 1 mm or less.

In addition, the chip antenna 100 may be disposed at a position not facing the patch antenna along the vertical direction of the substrate. The position not facing the patch antenna along the vertical direction of the substrate means a position that the chip antenna is not overlapped with the patch antenna when the chip antenna 100 is projected on the second surface of the substrate 10 along the vertical direction of the substrate.

The chip antenna 100 may be disposed so as not to face the ground structure 95 as well. However, the chip antenna 100 is not limited to such a configuration, but may be disposed to partially face the ground structure 95.

By the configuration as described above, the chip antenna module according to the examples may significantly reduce the interference between the chip antenna 100 and the patch antenna 90.

Figure 15:
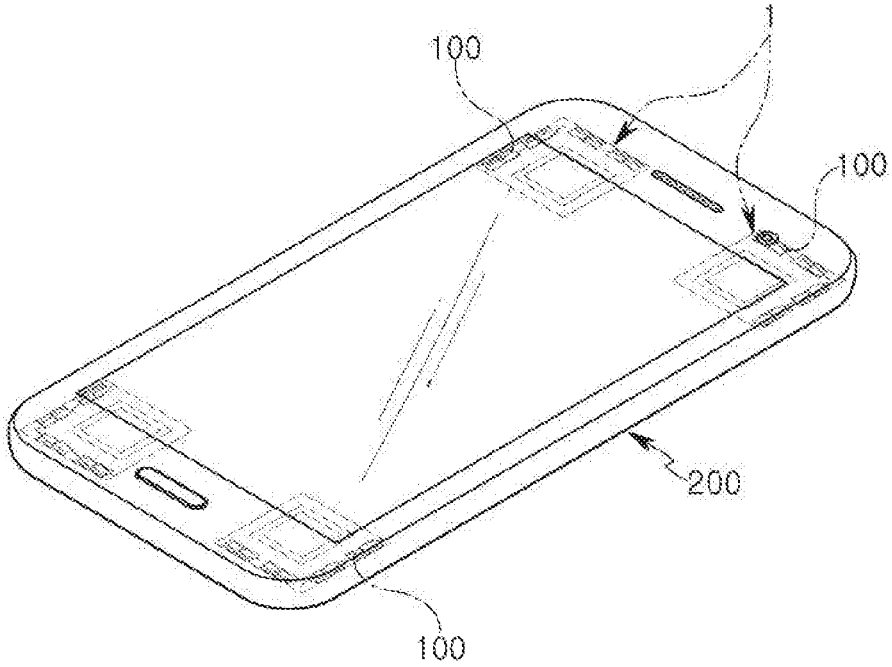
FIG. 15 is a perspective view schematically illustrating a portable terminal in which a chip antenna module according to an example is mounted.

FIG. 15 is a perspective view schematically illustrating a portable terminal in which the chip antenna module according to the examples may be mounted.

Referring to FIG. 15, chip antenna modules 1 may be disposed at corner portions of a portable terminal 200. In this case, the chip antenna modules 1 may be disposed so that the chip antennas 100 are adjacent to the corners (or a vertexes) of the portable terminal 200.

The present example describes a case in which the chip antenna modules 1 are disposed at all four corners of the portable terminal 200 as an example, but an arrangement structure of the chip antenna modules 1 is not limited thereto and may be variously modified. For example, when an internal space of the portable terminal 200 is insufficient, only two chip antenna modules may be disposed in a diagonal direction of the portable terminal 200.

In addition, the chip antenna module may be coupled to the portable terminal so that the feeding region is disposed to be adjacent to an edge of the portable terminal. In this case, the radio waves radiated through the chip antenna of the chip antenna module may be radiated toward the outside of the portable terminal in a direction of the surface of the portable terminal. In addition, the radio waves radiated through the patch antenna of the chip antenna module may be radiated in a thickness direction of the portable terminal.

The chip antenna module may use the chip antenna instead of the wiring type dipole antenna, thereby significantly reducing the size of the module. Further, transmission/reception efficiency may be improved.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A chip antenna module comprising:

a substrate comprising a plurality of layers;

a chip antenna comprising a first body portion formed of a first dielectric substance, a second body portion formed of a second dielectric substance, a ground portion, and a radiating portion; and an auxiliary patch disposed on at least another layer of the substrate below the radiating portion to be overlapped with the radiating portion along a direction perpendicular to the surface of the at least one layer, wherein the chip antenna is mounted on a surface of at least one layer of the substrate and configured to radiate a radio signal, and wherein the radiating portion is disposed between the first body portion and the second body portion, and wherein the ground portion is disposed to face the radiation portion with the first body portion interposed between the ground portion and the radiating portion.

2. The chip antenna module of claim 1, wherein the auxiliary patch is disposed in a portion of the substrate corresponding to the radiating portion with respect to a mounting direction of the chip antenna on the substrate.

3. The chip antenna module of claim 1, wherein a length of the auxiliary patch is the same as a length of the radiating portion.

4. The chip antenna module of claim 1, wherein the auxiliary patch comprises auxiliary patches disposed on different layers of the substrate.

5. The chip antenna module of claim 4, further comprising an auxiliary via connecting two or more of the auxiliary patches to each other.

6. The chip antenna module of claim 5, wherein the auxiliary via is electrically connected to the radiating portion.

7. The chip antenna module of claim 5, wherein the auxiliary via is disposed in a central region of the auxiliary patches in a length direction of the auxiliary patches.

8. The chip antenna module of claim 5, wherein the auxiliary via comprises two auxiliary vias, and the two auxiliary vias are disposed in different edge regions of the auxiliary patches in a length direction of the auxiliary patches.

9. The chip antenna module of claim 5, wherein the auxiliary via comprises auxiliary vias, and the auxiliary vias are spaced apart from each other in a length direction of the auxiliary patches.

10. A chip antenna module comprising:

a substrate comprising a plurality of layers;

a chip antenna mounted on a surface of at least one layer of the substrate and comprising a first block formed of a first dielectric substance and a second block formed of a second dielectric substance, a radiating portion, and a director disposed to face the radiating portion with the second block interposed between the director and the radiating portion; and an auxiliary patch disposed on at least another layer of the substrate below one or both of the radiating portion and the director to be overlapped with one or both of the radiating portion and the director along a direction perpendicular to the surface of the at least one layer, wherein the radiating portion is disposed between the first block and the second block, and wherein the ground portion is disposed to face the radiating portion with the first block interposed between the ground portion and the radiating portion.

11. The chip antenna module of claim 10, wherein the auxiliary patch comprises a first auxiliary patch disposed below the radiating portion and a second auxiliary patch disposed below the director.

12. The chip antenna module of claim 11, wherein the first auxiliary patch is disposed in a portion of the substrate corresponding to the radiating portion with respect to a mounting direction of the chip antenna on the substrate, and the second auxiliary patch disposed in a portion of the substrate corresponding to the director with respect to the mounting direction.

13. The chip antenna module of claim 11, wherein a length of the first auxiliary patch is the same as a length of the radiating portion, and a length of the second auxiliary patch is the same as a length of the director.

14. The chip antenna module of claim 10, wherein the auxiliary patch comprises auxiliary patches disposed on different layers of the substrate.

15. The chip antenna module of claim 14, further comprising an auxiliary via connecting the auxiliary patches to each other.

16. The chip antenna module of claim 15, wherein at least two of the auxiliary patches are connected to each other by the auxiliary via, and at least one auxiliary patch is electrically separated from the other auxiliary patches.

17. The chip antenna module of claim 15, wherein the auxiliary via is disposed in a central region of the auxiliary patches in a length direction of the auxiliary patches.

18. The chip antenna module of claim 15, wherein the auxiliary via comprises two auxiliary vias, and the two auxiliary vias are disposed in different edge regions of the auxiliary patches in a length direction of the auxiliary patches.

19. The chip antenna module of claim 15, wherein the auxiliary via comprises auxiliary vias, and the auxiliary vias are spaced apart from each other in a length direction of the auxiliary patches.

20. An electronic device, comprising:

the chip antenna module of claim 10.

21. A chip antenna module comprising:

a substrate;

a chip antenna mounted on the substrate and comprising a first body portion formed of a first dielectric substance, a second body portion formed of a second dielectric substance, a ground portion, and a radiating portion configured to radiate a radio signal mounted the substrate and comprising a radiating portion configured to radiate a radio signal; and auxiliary patches disposed in the substrate at positions corresponding to the radiating portion with respect to a mounting direction of the chip antenna on the substrate, the auxiliary patches comprising at least two auxiliary patches that are electrically connected to each other and at least one auxiliary patch that is not electrically connected to any other of the auxiliary patches, wherein the radiating portion is disposed between the first body portion and the second body portion, and wherein the ground portion is disposed to face the radiating portion with the first body portion interposed between the ground portion and the radiating portion.

22. The chip antenna module of claim 1, wherein the opposite surfaces of the body portion are perpendicular to the surface of the at least one layer of the substrate.

23. The chip antenna module of claim 10, wherein an interface between the radiating portion and the first block is perpendicular to the surface of the at least one layer of the substrate.

* * * * *